US007918201B2

(12) United States Patent
Yoshihara et al.

(10) Patent No.: US 7,918,201 B2
(45) Date of Patent: Apr. 5, 2011

(54) VARIABLE VALVE MECHANISM FOR ENGINE

(75) Inventors: Akira Yoshihara, Kyoto (JP); Yuichi Takahashi, Kawasaki (JP); Kenta Kotsuji, Uji (JP); Yasunori Kutsuna, Kyoto (JP); Akira Ohta, Kameoka (JP); Satoru Ishii, Kyoto (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 281 days.

(21) Appl. No.: 12/344,006

(22) Filed: Dec. 24, 2008

(65) Prior Publication Data

US 2009/0229549 A1 Sep. 17, 2009

(30) Foreign Application Priority Data

Mar. 13, 2008 (JP) ..... P.2008-063795

(51) Int. Cl.
*F01L 1/18* (2006.01)

(52) U.S. Cl. ..... 123/90.39; 123/90.16; 123/90.44; 74/559; 74/569

(58) Field of Classification Search ..... 123/90.16, 123/90.39, 90.44; 74/559, 567, 569
See application file for complete search history.

(56) References Cited

U.S. PATENT DOCUMENTS 6,886,512 B2 * 5/2005 Naumann ..... 123/90.39
2005/0066921 A1 3/2005 Yasunori et al.

FOREIGN PATENT DOCUMENTS

JP 2005-105953 A 4/2005

* cited by examiner

*Primary Examiner* — Ching Chang
(74) *Attorney, Agent, or Firm* — Birch, Stewart, Kolasch & Birch, LLP

(57) ABSTRACT

A variable valve mechanism for an engine includes: a rocker shaft; a first rocker arm rotatably supported by the rocker shaft, for transmitting displacement of a first cam to a valve; a second rocker arm rotatably supported by the rocker shaft, for transmitting a displacement of a second cam to the valve; and a switching mechanism for switching a transmitting state and a non-transmitting state. The first rocker arm has a pair of first arm portions and a recess portion in which an upper end of the valve is inserted at an end portion of each of the first arm portions. The second rocker arm has a second arm portion disposed between the first arm portions. The first rocker arm is restricted from movement in an axis direction of the rocker shaft when an inner sidewall of the recess portion is in contact with the upper end of the valve. The second rocker arm is restricted from movement in the axis direction when the second arm portion is in contact with the first rocker arm.

2 Claims, 5 Drawing Sheets

VARIABLE VALVE MECHANISM FOR ENGINE

BACKGROUND OF THE INVENTION

The present invention relates to a variable valve mechanism for an engine.

In an engine, improvement in both output and fuel efficiency is realized by assembling a cam-switching variable valve device onto a valve operating system. The variable valve device is a device for switching the opening/closing timing of a valve and the lifting amount thereof by switching cams. In the variable valve device, a plurality of types of cams different in cam profile from each other are provided side by side on a camshaft. And, by selectively switching rocker arms that follow these cams, displacement of the cam to be transmitted to the valve is changed.

In such a case that an engine is mounted in an automobile, with the aim of making the cylinder head itself compact while avoiding engine components, the camshaft is disposed obliquely above the rocker shaft, for example. Such a variable valve device assembled on an engine has been disclosed in, for example, JP-A-2005-105953. The variable valve device for an engine disclosed in JP-A-2005-105953 includes a low-speed rocker arm linked to a valve and a high-speed rocker arm combined with the low-speed rocker arm. Both rocker arms are attached so as to be swingable while being fitted to the outside of the rocker shaft, and structured so that a cam displacement is transmitted from the high-speed rocker arm to the low-speed rocker arm.

In the switching mechanism disclosed in JP-A-2005-105953, it can be said that the low-speed rocker arm can be restricted from displacement to both sides in a rocker shaft axis direction, while the high-speed rocker arm is restricted from displacement in the rocker shaft axis direction in only one direction to hit against the low-speed rocker arm. In detail, as shown in FIG. 2 of JP-A-2005-105953, the high-speed rocker arm is structured to be restricted from displacement in a direction of arrow D as a result of hitting against the low-speed rocker arm but to be displaceable in a direction of arrow C opposite to the arrow D direction. Therefore, in the switching mechanism, for restricting the high-speed rocker arm from displacement in the arrow C direction, it is necessary to position the high-speed rocker arm by the cylinder head by, for example, making the high-speed rocker arm abut against a part of the cylinder head. However, when the rocker arm abuts against the cylinder head, friction occurs at a contact part therebetween at the time of rocker arm operation, and thus a smooth operation of the rocker arm is hindered.

Furthermore, the switching mechanism has a structure where an arm of the high-speed rocker arm is located at a back face side of a boss portion of the low-speed rocker arm, and the cylinder head is increased in width for that. Alternatively, for forming a bearing portion of the rocker shaft in the cylinder head, a rod-like tool is inserted inside the cylinder head and cutting is performed, and in order to secure a space for inserting the tool, it is also necessary to increase the cylinder head in size. Accordingly, it can be said that, for applying the variable valve device of JP-A-2005-105953, there is a tendency that the engine as a whole is increased in size.

SUMMARY

It is therefore an object of the invention to provide a variable valve mechanism for an engine that can secure smooth operating performance of the rocker arms while allowing for downsizing of the engine.

In order to achieve the object, according to the invention, there is provided a variable valve mechanism for an engine comprising:

a rocker shaft which is arranged to a cylinder head;

a first rocker arm which is rotatably supported by the rocker shaft, for transmitting displacement of a first cam to a valve;

a second rocker arm which is combined with the first rocker arm and which is rotatably supported by the rocker shaft, for transmitting a displacement of a second cam to the valve; and a switching mechanism for switching a transmitting state where a displacement of the second rocker arm is transmitted to the first rocker arm and for switching a non-transmitting state where the displacement of the second rocker arm is not transmitted to the first rocker arm, wherein the first rocker arm has a pair of first arm portions extending from a side of the rocker shaft to a side of the valve, and has a recess portion in which an upper end of the valve is inserted at an end portion of each of the first arm portions, the second rocker arm has a second arm portion disposed between the pair of first arm portions, and the first rocker arm is restricted from movement in an axis direction of the rocker shaft when an inner sidewall of the recess portion is in contact with the upper end of the valve, and the second rocker arm is restricted from movement in the axis direction of the rocker shaft when the second arm portion is in contact with the first rocker arm.

The switching mechanism may be disposed above or below the rocker shaft.

DETAILED DESCRIPTION OF PREFERRED EMBODIMENTS

A best mode for carrying out a variable valve mechanism for an engine according to the present invention will now be described in detail based on the drawings.

First Embodiment

A first embodiment where a variable valve mechanism for an engine according to the present invention is applied to an engine where a plurality of cylinders are disposed in series along the front and rear direction of an engine body will be described by using FIG. 1 to FIG. 5.

Figure 1:
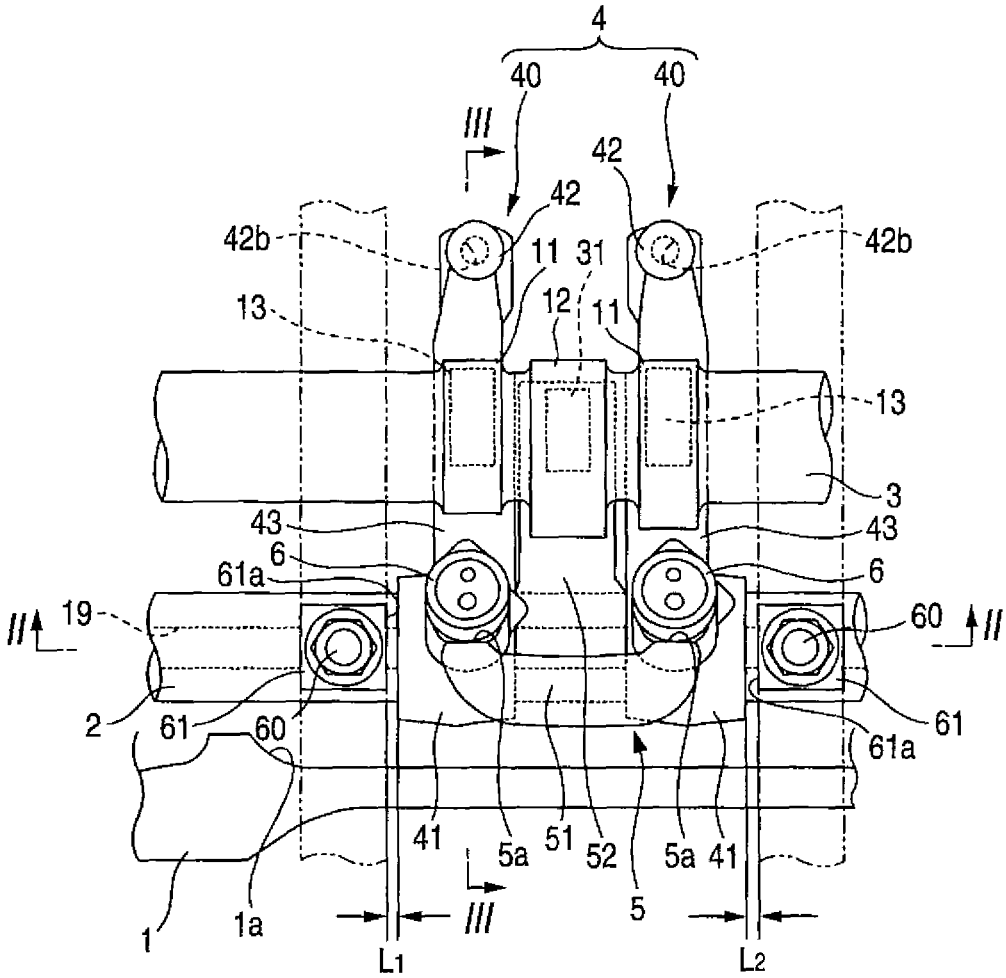
FIG. 1 is a plan view showing a rocker arm provided corresponding to the intake side of one of a plurality of cylinders in an internal-combustion cylinder head including a variable valve mechanism for an engine according to the first embodiment of the present invention.
Figure 2:
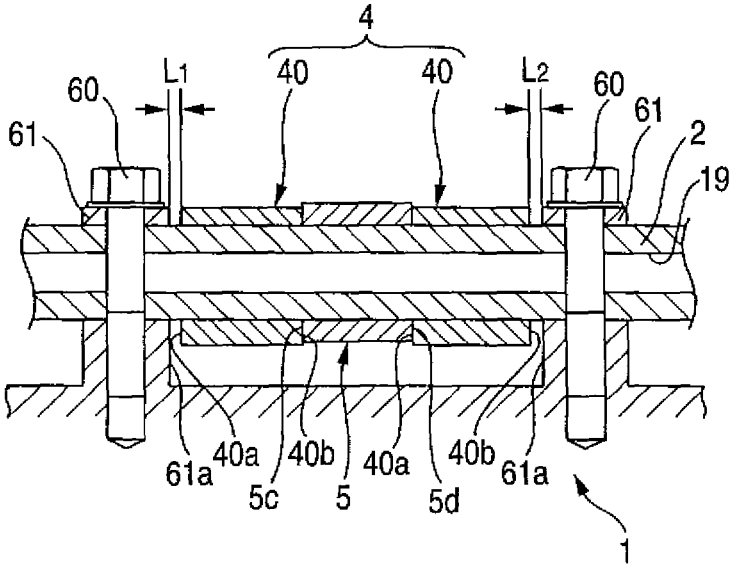
FIG. 2 is a view taken along an arrow line II-II in FIG. 1.
Figure 3:
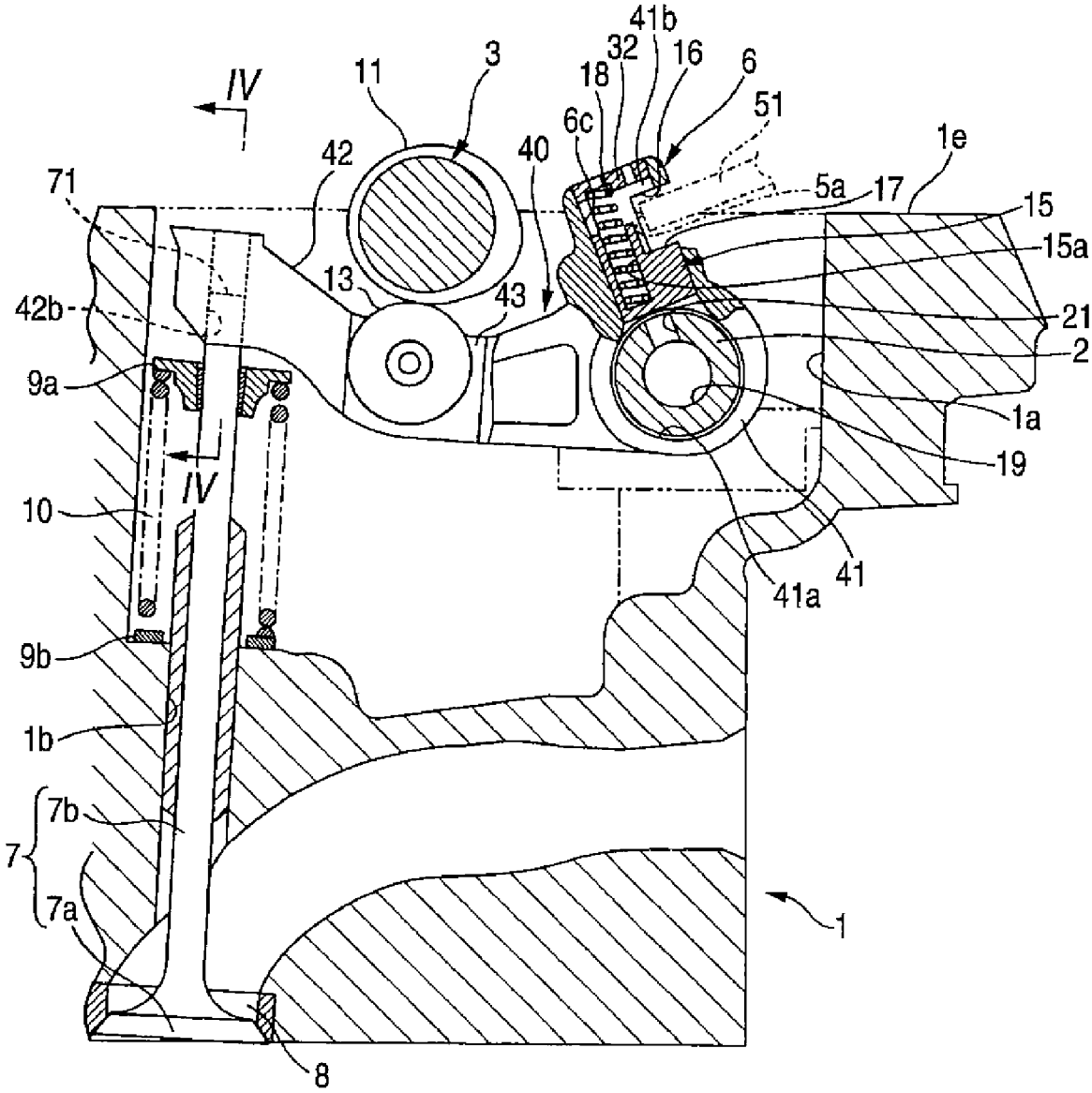
FIG. 3 is a view taken along an arrow line III-III in FIG. 1.
Figure 4:
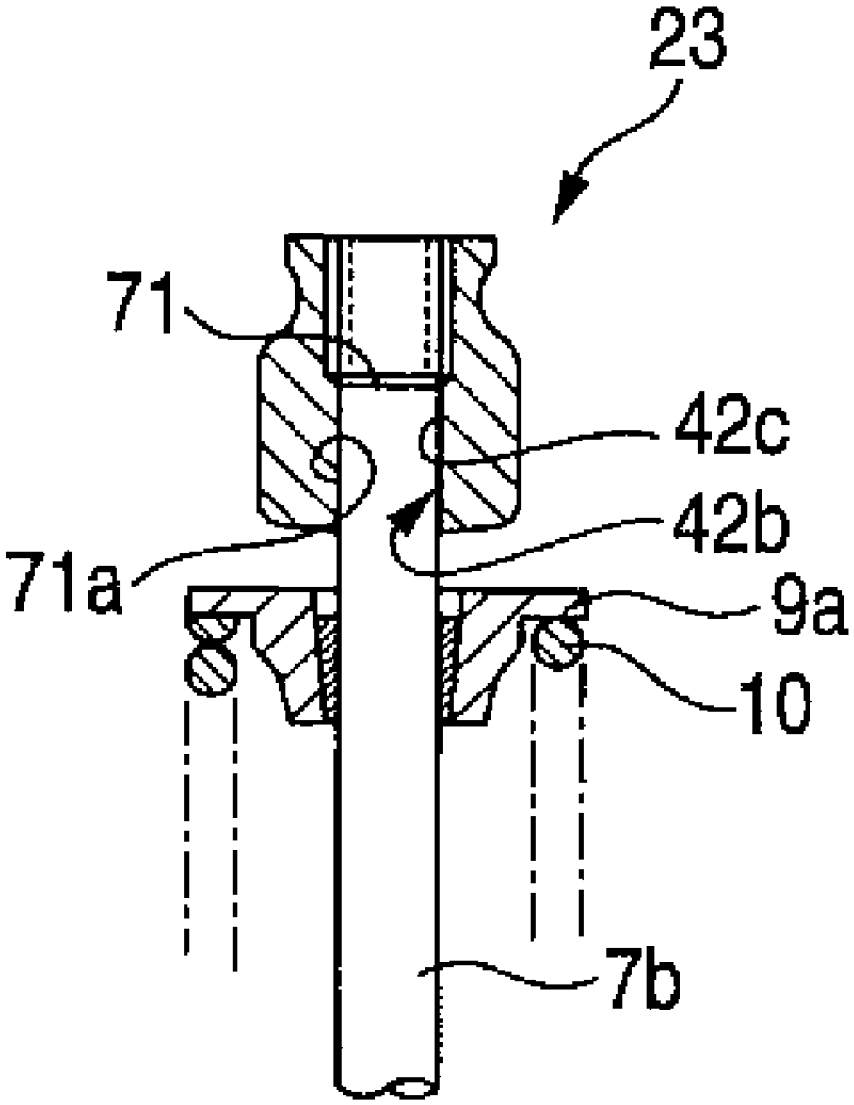
FIG. 4 is a view taken along an arrow line IV-IV in FIG. 3.
Figure 5:
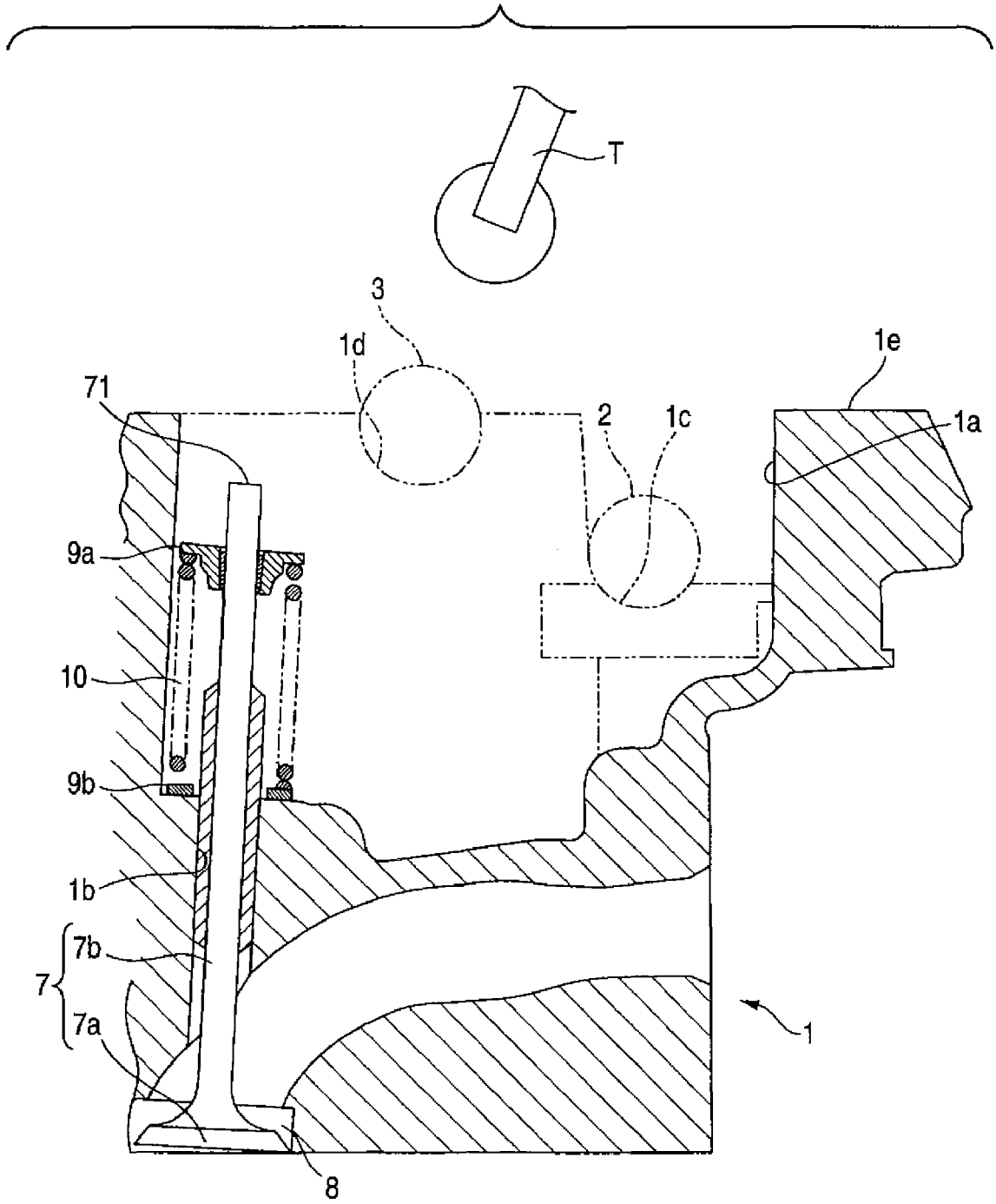
FIG. 5 is an explanatory view showing a state when a cylinder head in which a variable valve mechanism for an engine according to the first embodiment of the present invention is provided.

FIG. 1 is a plan view showing a rocker arm provided corresponding to the intake side of one of a plurality of cylinders in an internal-combustion cylinder head including a variable valve mechanism for an engine, FIG. 2 is a view taken along an arrow line II-II in FIG. 1, FIG. 3 is a view taken along an arrow line III-III in FIG. 1, and FIG. 4 is a view taken along an arrow line IV-IV in FIG. 3. FIG. 5 is an explanatory view showing a state when processing a cylinder head in which a variable valve mechanism for an engine is provided.

As shown in FIG. 1 to FIG. 3, a variable valve mechanism for an engine according to the present embodiment includes a rocker shaft 2, a camshaft 3, rocker arms (a first rocker arm 4 and a second rocker arm 5), etc.

The rocker shaft 2 is arranged to the cylinder head 1. Specifically, the rocker shaft 2 is, in the vicinity of a sidewall 1*a* at the intake side of the cylinder head 1, attached by a bolt 60 to a bulkhead portion 61 of the cylinder head 1 so as to lie along the front and rear direction (left and right direction of FIG. 1) of the cylinder head 1. The rocker shaft 2 is attached with a first rocker arm 4 having a pair of first arm bodies (first arm portions) 40 and a second rocker arm 5 provided between the first arm bodies 40. In addition, the first rocker arm 4 and the second rocker arm 5 are rotatably supported by the rocker shaft 2. A set of these first and second rocker arms 4 and 5 is attached corresponding to each cylinder of the engine. A main oil passage 19 is formed at an axial center portion of the rocker shaft 2.

The camshaft 3 is located at a central side in the width direction of the cylinder head 1 (upper side of FIG. 1 and left side of FIG. 3) further than the rocker shaft 2, and disposed at an upper side in the height direction of the cylinder head 1 (upper side of FIG. 3) further than the rocker shaft 2. Although the camshaft 3 is disposed at both intake and exhaust sides of the cylinder head 1, only the one at the intake side is illustrated in FIG. 1 and FIG. 3. The camshaft 3 is rotatably supported on the cylinder head 1. The camshaft 3 is formed with a first cam 11 and a second cam 12. The first cam 11 abuts against the first rocker arm 4, and the second cam 12 abuts against the second rocker arm 5. The second cam 12 is larger in lift amount than the first cam 11, and has a cam profile that includes the first cam 11.

The first arm body 40 has a base end portion 41, a front end portion 42, and a central portion 43 therebetween. The base and portion 41 is attached to the rocker shaft 2, the central portion 43 extends from the base end portion 41, and the front end portion 42 is formed at the front end of the central portion 43. In a side view (see FIG. 3), the overall shape of the first arm body 40 is a shape slightly recessed downward at the central portion 43 further than at the base end portion 41 and the front end portion 42 being both sides of the central portion 43. The central portion 43 is rotatably attached with a first roller 13 that makes rolling contact with the first cam 11 of the camshaft 3. The first roller 13 makes sliding contact with the first cam 11 of the camshaft 3 from the lower side.

The base end portion 41 is provided with a hole 41*a* through which the rocker shaft 2 is inserted. At the upper side of the hole 41*a*, a housing portion 41*b* of a switching mechanism 6 is formed. The housing portion 41*b* has a circular cylindrical space inside, which is closed at its upper end by a lid member 32. Although details will be described later, the switching member 6 functions to switch both the first rocker arm 4 and the second rocker arm 5 into a connected state or a disconnected state.

The front end portion 42 is formed with a recess portion 42*b* opened downward. In the recess portion 42*b*, the front end portion 42 is linked to an intake valve 7.

The intake valve 7 has a valve head 7*a* and a valve stem 7*b*. The intake valve 7 is attached so that the valve stem 7*b* slides up and down in a hole 1*b* of the cylinder head 1 in contact therewith, and the valve head 7*a* opens and closes an intake port 8. Therefore, the valve stem 7*b* is positioned by the hole 1*b* of the cylinder head 1. On the outer periphery of the valve stem 7*b*, between valve sheet members 9*a* and 9*b*, a spring 10 in a compressed state is disposed. By the spring 10, the intake valve 7 is normally urged upward to close the intake port 8, and when the valve stem 7*b* is depressed by swinging of the first rocker arm 4, the intake port 8 is opened.

An upper end portion (upper valve end) 71 of the valve stem 7*b*, as shown in FIG. 3 and FIG. 4, is inserted in the recess portion 42*b* of the first arm body 40. An inner sidewall 42*c* of the recess portion 42*b* makes sliding contact with a peripheral wall portion 71*a* of the upper end portion 71 of the valve stem 7*b*. Via the recess portion 42*b*, the valve stem 7*b* and the front end portion 42 of the first arm body 40 are linked. Consequently, the front end portion 42 side of the first arm body 40 is restricted from movement in a rocker shaft axis direction and positioned by the valve stem 7*b* and the recess portion 42*b*.

On the other hand, the base end portion 41 side of the first arm body 40 is attached in a manner fitted with the rocker shaft 2. Accordingly, positioning of the front end portion 42 side of the first arm body 40 causes positioning also of the base end portion 41 side thereof in the rocker shaft axis direction. More specifically, the first arm body 40 is restricted from movement in a cylinder head front and rear direction (rocker shaft axis direction) as a result of the inner sidewall 42*c* of the recess portion 42*b* hitting against (being in contact with) the upper end portion 71 of the valve stem 7*b*.

At a lower portion of the front end portion 42 of the first arm body (hereinafter, referred to as the other first arm body) 40 disposed at the right side of the second rocker arm 5, the recess portion 42*b* is formed (see FIG. 1). In the recess portion 42*b* of the other first arm body 40, similar to the first arm body (hereinafter, referred to one first arm body) 40 disposed at the left side of the second rocker arm 5 described above, an upper end portion of the valve stem (not shown) enters. And, an inner sidewall (not shown) of the recess portion 42*b* makes sliding contact with a peripheral wall portion of the upper end portion of the valve stem. Therefore, similar to the one first arm body 40, the other first arm body 40 is also restricted from movement in the cylinder head front and rear direction (rocker shaft axis direction) as a result of the inner sidewall of the recess portion 42*b* hitting against (being in contact with) the upper end portion of the valve stem. Consequently, the pair of first arm bodies 40 restrict the second rocker arm 5 from movement in the cylinder head front and rear direction (rocker shaft axis direction).

Thus the second rocker arm 5 is restricted by the first rocker arm 4 from movement in the rocker shaft axis direction, and the first rocker arm 4 is restricted by the intake valve 7 from movement in the rocker shaft axis direction. Therefore, it becomes unnecessary to form a positioning portion for positioning the first rocker arm 4 in the cylinder head 1, so that a simple structure can be realized. Furthermore, the first rocker arm 4 can be positioned without making contact with the cylinder head 1. The one first arm body 40 can be, as shown in FIG. 1 and FIG. 2, disposed with a gap L1 provided between the same and a wall face 61*a* of the bulkhead portion 61 of the cylinder head 1. The other first arm body 40 can be, as shown in FIG. 1 and FIG. 2, disposed with a gap L2 provided between the same and a wall face 61*a* of the bulkhead portion 61 of the cylinder head 1. Consequently, contact of a side portion 40*a* of the one first arm body 40 with the wall face 61*a* of the bulkhead portion 61 is avoided. Contact of a side portion 40*b* of the other first arm body 40 with the wall face 61*a* of the bulkhead portion 61 is avoided. As a result, no friction occurs at the time of rocker arm operation with respect to the cylinder head 1, so that the first rocker arm 4 can be smoothly operated.

The second rocker arm 5 has a second arm body (second arm portion) 52 disposed between the pair of first arm bodies 40 and a T-shaped portion 51 disposed at the base end portion 41 side of the first arm body 40. The second arm body 52 is attached with a second roller 31 that makes rolling contact with the second cam 12 of the camshaft 3. The second roller 31 makes sliding contact with the second cam 12 of the camshaft 3 from the lower side. Both end portions 5*a* of the T-shaped portion 51 are made connectable and disconnectable to the base end portion 41 of the first rocker arm 4 via the switching mechanism 6 provided for each of the pair of first arm bodies 40 of the first rocker arm 4 described above.

Here, description will be given of the switching mechanism 6.

As shown in FIG. 3 for easy understanding, the switching mechanism 6 includes a piston 15 disposed in the housing portion 41*b* of the base end portion 41 of the first rocker arm 4 so as to be slidable in contact therewith. At a back face side (opposite side to the camshaft 3) of the housing portion 41*b*, a notch portion 16 is formed. The notch portion 16 is formed by notching the housing portion 41*b* at a part of the back face side in a square form. The end portion 5*a* of the T-shaped portion 51 of the second rocker arm 5 faces onto the notch portion 16.

The piston 15 is a cylindrical member that makes sliding contact with an inner wall of the housing portion 41, and provided with a latching step portion 17 at a part of the upper end. The piston 15 is formed with a hole 15*a* to house a return spring 18. The return spring 18 is disposed in a compressed state between the lid member 32 and the hole 15*a* of the piston 15. By the return spring 18, the piston 15 is urged downward (the side to approach the rocker shaft 2) to be normally in a state to open the notch portion 16 (a state of FIG. 2). The piston 15 is structured to rise against an urging force of the return spring 18 due to pressure oil supplied from an oil passage 21 formed in the rocker shaft 2.

It is assumed that the engine drives in a low rotation speed area. At this time, as described above, there is a state where the piston 15 is urged downward by the return spring 18 and the notch portion 16 is opened (a state with no pressure oil being supplied). In this state, the end portion 5*a* of the T-shaped portion 51 of the second rocker arm 5 is not latched with the notch portion 16 of the housing portion 41*b* of the first rocker arm 4, so that the second rocker arm 5 and the first rocker arm 4 are not connected to each other. Therefore, a displacement of the second rocker arm 5 is not transmitted to the first rocker arm 4, and the intake valve 7 is transmitted with an operation of the first rocker arm 4.

On the other hand, it is assumed that engine drives in a high rotation speed area. At this time, pressure oil in the main oil passage 19 of the rocker shaft 2 is supplied into the housing portion 41*b* through the oil passage 21. Then, the piston rises against the urging force of the return spring 18, and due to the rise of the piston 15, the latching step portion 17 is also displaced upward to reduce the space of the notch portion 16. In this state, the end portion 5*a* of the T-shaped portion 51 of the second rocker arm 5 is pressed from downward by the piston 15 in the notch portion 16 of the housing portion 41*b* of the first rocker arm 4, so that the second rocker arm 5 is connected to the first rocker arm 4. Therefore, when the second rocker arm 5 swings, the first rocker arm 4 also swings in conjunction therewith. As a result, in a manner following the cam profile of the second cam 12, the front end portion 42 side of the first rocker arm 4 swings. A displacement of the second cam 12 transmitted to the first rocker arm 4 is transmitted to the upper end portion 71 of the valve stem 7*b* to depress the intake valve 7. Consequently, the intake valve 7 is transmitted with the cam profile of the second cam 12 via the second rocker arm 5 and the first rocker arm 4.

As described above, the first arm body 40 is restricted from movement in the rocker shaft axis direction as a result of the inner sidewall 42*c* of the recess portion 42*b* hitting against (being in contact with) the upper end portion 71 of the valve stem 7*b*. In addition, the second rocker arm 5 is restricted from movement in the rocker shaft axis direction as a result of the second arm body 52 hitting against (being in contact with) the pair of first arm bodies 40. More specifically, as a result of the upper end portion 71 of the valve stem 7*b* entering the recess portion 42*b* of the first arm body 40, the front end portion 42 of the first arm body 40 is positioned in the rocker shaft axis direction by using the intake valve 7. As a result of the rocker shaft 2 being inserted in the hole 41*a* of the first arm body 40, the base end portion 41 side of the first arm body 40 is positioned in the rocker shaft axis direction by using the rocker shaft 2. On the other hand, the second rocker arm 5 has the second arm body 52 to be disposed between the pair of first arm bodies 40. One side portion 5*c* of the second arm body 52 contacts one side portion 40*b* of the one first arm body 40. The other side portion 5*d* of the second arm body 52 contacts the other side portion 40*a* of the other first arm body 40. Consequently, the pair of first arm bodies 40 restrict the second arm body 52 from movement in the rocker shaft axis direction. As a result, the second rocker arm 5 is positioned in the rocker shaft axis direction. Accordingly, it becomes unnecessary to form a positioning portion for positioning the first rocker arm 4 in the cylinder head 1. Consequently, positioning in the rocker shaft axis direction of the first and second rocker arms 4 and 5 can be performed by a simple structure of providing the recess portion 42*b* at the lower portion of the front end portion 42 of the first arm body 40.

As described above, since it is unnecessary to make the wall face 61*a* of the bulkhead portion 61 of the cylinder head 1 contact the first rocker arm 4, said first rocker arm 4 can be reduced in size as compared with a first rocker arm for making contact with a bulkhead of a cylinder head. Therefore, the first rocker arm 4 can be improved in dynamic characteristics as compared with a first rocker arm for making contact with a bulkhead of a cylinder head.

Moreover, due to downsizing of the first rocker arm 4, a fixing portion 1*c* for fixing the rocker shaft 2 to support the first rocker arm 4 can be disposed in the vicinity of an upper portion 1*e* of the cylinder head 1. As a result, the engine can be downsized in the height direction (upper and lower direction in FIG. 3) Furthermore, as a result of the fixing portion 1*c* being disposed in the vicinity of the upper portion 1*e* of the cylinder head 1, it becomes possible, as shown in FIG. 5, to move a rotating tool T for processing the cylinder head 1 to the vicinity of the fixing portion 1*c* and the vicinity of a fixing portion 1*d* where a bearing portion to rotatably support the camshaft 3 is fixed, and thus the processing becomes easy.

As described above, the switching mechanism 6 is disposed above the rocker shaft 2 being at the base end portion 41 side of the first rocker arm 4. This allows reducing the space between the rocker shaft 2 and the sidewall 1*a* of the cylinder head 1 (inner wall of the cylinder head). As a result, this can contribute to downsizing of the cylinder head 1 in the width direction (left and right direction in FIG. 3). Particularly, in a structure where the camshaft 3 is disposed obliquely above the rocker shaft 2, the switching mechanism 6 can be arranged above the rocker shaft 2 (lateral to the camshaft 3 (right lateral to the camshaft 3 in FIG. 3) ) and making effective use of the space inside the cylinder head 1 allows contributing to downsizing of the cylinder head 1.

Second Embodiment

A second embodiment where a variable valve mechanism for an engine according to the present invention is applied to an engine where a plurality of cylinders are disposed in series along the front and rear direction of an engine body will be described in detail by using FIG. 6 and FIG. 7.

Figure 6:
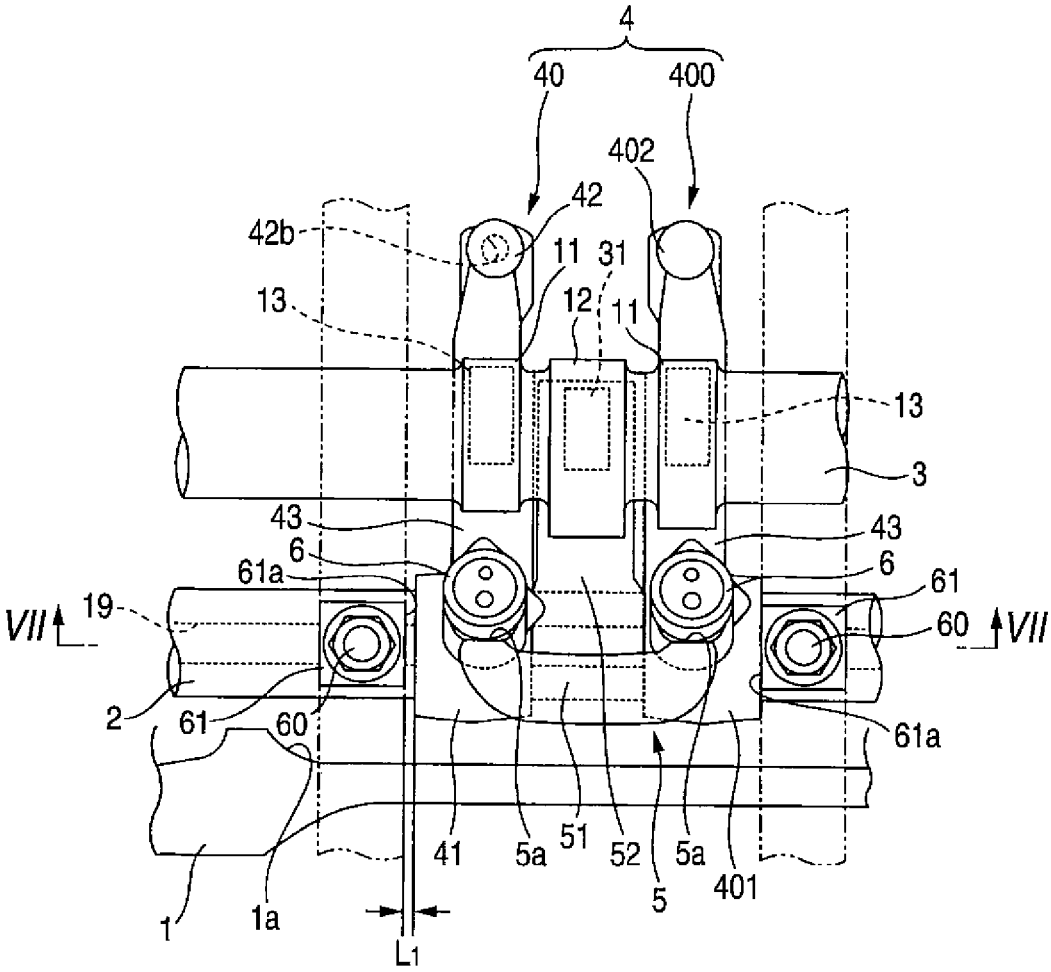
FIG. 6 is a plan view showing a rocker arm provided corresponding to the intake side of one of a plurality of cylinders in an internal-combustion cylinder head including a variable valve mechanism for an engine according to the second embodiment of the present invention.
Figure 7:
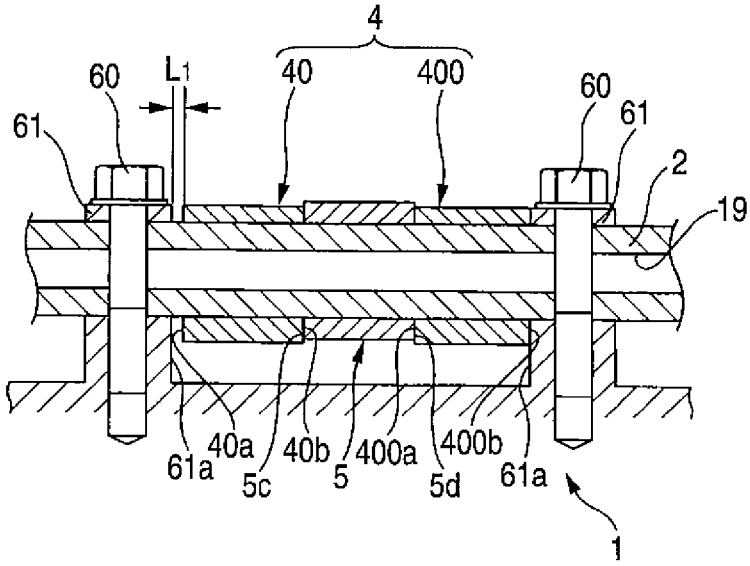
FIG. 7 is a view taken along an arrow line VII-VII in FIG. 6.

FIG. 6 is a plan view showing a rocker arm provided corresponding to the intake side of one of a plurality of cylinders in an internal-combustion cylinder head including a variable valve mechanism for an engine, and FIG. 7 is a view taken along an arrow line VII-VII in FIG. 6.

A variable valve mechanism for an engine according to the present embodiment is a mechanism modified in the other arm body (the first arm body disposed at the right side of the second rocker arm 5 in FIG. 6 and FIG. 7) of the pair of first arm bodies that the variable valve mechanism for an engine according to the first embodiment described above includes, and a mechanism including the same members (for example, the second rocker arm 5, one first arm body 40, etc.) except for the other arm body. In the present embodiment, the same members as those of the variable valve mechanism for an engine according to the first embodiment described above will be denoted by the same reference numerals and will be omitted from description.

A variable valve mechanism for an engine according to the present embodiment includes, as shown in FIG. 6 to FIG. 7, a first rocker arm 4 having a pair of first arm bodies 40 and 400. The front end portion 42 of the first arm body 40 disposed at the left side in FIG. 6 is formed with the recess portion 42*b*. On the other hand, a front end portion 402 of the first arm body 400 disposed at the right side in FIG. 6 is formed with no recess portion. Therefore, the one first arm body 40 is positioned in the rocker shaft axis direction by the valve (not shown), the recess portion 42*b*, and the rocker shaft 2. In addition, the gap L1 can be provided between a sidewall portion 400*b* of the first arm body 400 and the wall face 61*a* of the bulkhead portion 61 of the cylinder head 1. The other first arm body 400 is not positioned in the rocker shaft axis direction by a valve and a recess portion, but positioned in the rocker shaft axis direction by contact between the sidewall portion 40*a* of the first arm body 40 and the wall face 61*a* of the bulkhead 61 of the cylinder head 1. Also, reference numeral 401 denotes a base end portion of the first arm body 400, and reference numeral 402 denotes a front end portion of the first arm body 400.

Therefore, according to the variable valve mechanism for an engine according to the present embodiment, one side portion (side portion at the first arm body 40 side) 5*c* of the second rocker arm 5 is positioned by the first arm body 40 in the rocker shaft axis direction. On the other hand, the other side portion 5*d* (side portion at the first arm body 400 side) is positioned in the rocker shaft axis direction by contact between the wall face 61*a* of the bulkhead 61 of the cylinder head 1 and the sidewall portion 400*b* of the first arm body 400. Consequently, it becomes unnecessary to entirely process the wall face 61*a* of the bulkhead portion 61 of the cylinder head 1 corresponding to the intake side of a cylinder where the first and second rocker arms 4 and 5 are disposed. As a result, the processing part is reduced as compared to when processing the entire wall face of a bulkhead portion of such a cylinder head, and manufacturing becomes easier for that.

According to the variable valve mechanism for an engine of the present invention, the first rocker arm is restricted from movement in the rocker shaft axis direction by the valve, and the second rocker arm is restricted from movement in the rocker shaft axis direction by the first rocker arm. This makes it unnecessary to form a positioning portion for positioning the first rocker arm in the cylinder head, so that a simple structure can be realized. Further, since the rocker arm can be positioned without making contact with the cylinder head, no friction occurs at the time of rocker arm operation with respect to the cylinder head, so that the first rocker arm can be more smoothly operated.

What is claimed is:

1. A variable valve mechanism for an engine comprising:

a rocker shaft which is arranged to a cylinder head;

a first rocker arm which is rotatably supported by the rocker shaft, for transmitting displacement of a first cam to a valve;

a second rocker arm which is combined with the first rocker arm and which is rotatably supported by the rocker shaft, for transmitting a displacement of a second cam to the valve; and a switching mechanism for switching a transmitting state where a displacement of the second rocker arm is transmitted to the first rocker arm and for switching a non-transmitting state where the displacement of the second rocker arm is not transmitted to the first rocker arm, wherein the first rocker arm has a pair of first arm portions extending from a side of the rocker shaft to a side of the valve, and has a recess portion in which an upper end of the valve is inserted at an end portion of each of the first arm portions, the second rocker arm has a second arm portion disposed between the pair of first arm portions, and the first rocker arm is restricted from movement in an axis direction of the rocker shaft when an inner sidewall of the recess portion is in contact with the upper end of the valve, and the second rocker arm is restricted from movement in the axis direction of the rocker shaft when the second arm portion is in contact with the first rocker arm.

2. The variable valve mechanism according to claim 1, wherein the switching mechanism is disposed above or below the rocker shaft.

* * * * *